US011333178B2

(12) United States Patent
Imai et al.

(10) Patent No.: US 11,333,178 B2
(45) Date of Patent: May 17, 2022

(54) VORTEX RING GENERATION DEVICE

(71) Applicant: DAIKIN INDUSTRIES, LTD., Osaka (JP)

(72) Inventors: Yousuke Imai, Osaka (JP); Masafumi Uda, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/212,543

(22) Filed: Mar. 25, 2021

(65) Prior Publication Data

US 2021/0207629 A1 Jul. 8, 2021

Related U.S. Application Data

(63) Continuation of application No. PCT/JP2019/037591, filed on Sep. 25, 2019.

(30) Foreign Application Priority Data

Sep. 28, 2018 (JP) ..... JP2018-184725

(51) Int. Cl.
*F15C 1/16* (2006.01)
*F15D 1/00* (2006.01)
(Continued)

(52) U.S. Cl.
CPC ..... *F15D 1/009* (2013.01); *F24F 8/80* (2021.01); *F15C 1/14* (2013.01); *F15C 1/16* (2013.01); *F24F 7/003* (2021.01); *F24F 2221/46* (2013.01)

(58) Field of Classification Search
CPC .... F15D 1/009; F15C 1/16; F15C 1/14; F14F 8/80; F14F 7/003; F14F 2221/46
(Continued)

(56) References Cited

U.S. PATENT DOCUMENTS 2,855,714 A * 10/1958 Thomas ..... A63H 33/28 42/57
3,396,738 A * 8/1968 Heskestad ..... F04D 29/681 137/13
(Continued)

FOREIGN PATENT DOCUMENTS

CN 103608587 A 2/2014
JP 2008-257216 A 10/2008
(Continued)

OTHER PUBLICATIONS

International Search Report of corresponding PCT Application No. PCT/JP2019/037591 dated Nov. 5, 2019.
(Continued)

*Primary Examiner* — Minh Q Le
(74) *Attorney, Agent, or Firm* — Global IP Counselors, LLP

(57) ABSTRACT

A vortex ring generation device includes a casing having a discharge port, an extrusion mechanism, and a component supply port. The extrusion mechanism extrudes air in an air passage inside the casing such that the air is discharged, in a vortex ring shape, from the discharge port. The component supply port surrounds the air passage. A total circumferential length of the component supply port is ½ or more of a total circumferential length of the discharge port. The extrusion mechanism includes a vibration plate and a drive unit that vibrates the vibration plate. The air passage includes a first passage, and a throttle passage continuous with a downstream end of the first passage. A component chamber is provided inside the casing. The component chamber contains a discharge component to be supplied to the component supply port. The component supply port is located downstream of the throttle passage.

20 Claims, 7 Drawing Sheets

(51) Int. Cl.
*F24F 8/80* (2021.01)
*F24F 7/003* (2021.01)
*F15C 1/14* (2006.01)

(58) Field of Classification Search
USPC ..... 138/37; 137/808, 809, 810, 811, 812, 137/813; 239/3, 699
See application file for complete search history.

(56) References Cited

U.S. PATENT DOCUMENTS 3,589,603 A * 6/1971 Fohl ..... F15D 1/08 239/11
3,885,931 A * 5/1975 Schaller ..... B04C 5/02 95/269
4,157,703 A * 6/1979 Brown ..... A63F 9/0252 124/55
4,534,914 A * 8/1985 Takahashi ..... B01F 13/0222 261/64.3
5,181,475 A * 1/1993 Breen ..... F23C 1/00 110/212
5,474,059 A 12/1995 Cooper
5,483,953 A * 1/1996 Cooper ..... A61M 11/06 128/200.14
6,824,125 B2 * 11/2004 Thomas ..... A01K 63/042 261/121.1
7,059,544 B2 * 6/2006 Leonard ..... A01M 1/2033 239/398
7,204,431 B2 * 4/2007 Li ..... H01J 49/167 239/3
7,673,834 B2 * 3/2010 Harman ..... F42B 10/24 244/199.1
8,607,774 B2 * 12/2013 Davis ..... F41B 9/0037 124/55
9,092,953 B1 * 7/2015 Mortimer ..... G06F 3/016
9,339,772 B1 * 5/2016 Brav ..... B05B 7/0483
2003/0160105 A1 * 8/2003 Kelly ..... B05B 5/035 239/3
2008/0264505 A1 * 10/2008 Matsuo ..... B60H 3/0028 137/808
2013/0214054 A1 * 8/2013 Faulkner ..... B05B 5/03 239/3
2014/0147308 A1 5/2014 Fujiwara et al.
2015/0129040 A1 * 5/2015 Hartig ..... B63J 2/02 137/1
2015/0300385 A1 10/2015 Akagi et al.
2015/0328960 A1 * 11/2015 Castillo ..... B60H 1/00457 454/155
2016/0045696 A1 * 2/2016 Siriwardena ..... A61B 5/0205 128/204.23
2017/0057772 A1 * 3/2017 Prinsen ..... B65H 29/52
2019/0238975 A1 * 8/2019 Dalmas, II ..... F02M 61/08

FOREIGN PATENT DOCUMENTS

JP 2016-86988 A 5/2016
JP 2017-53592 A 3/2017
JP 2017-198433 A 11/2017
JP 2018-115837 A 7/2018
JP 2018-115838 A 7/2018
JP 2018-204889 A 12/2018
WO 2008/093721 A1 8/2008
WO 2014/017208 A1 1/2014

OTHER PUBLICATIONS

International Preliminary Report of corresponding PCT Application No. PCT/JP2019/037591 dated Apr. 8, 2021.
European Search Report of corresponding EP Application No. 19 86 5070.7 dated Aug. 20, 2021.

* cited by examiner

VORTEX RING GENERATION DEVICE

CROSS-REFERENCE TO RELATED APPLICATIONS

This is a continuation of International Application No. PCT/JP2019/037591 filed on Sep. 25, 2019, which claims priority to Japanese Patent Application No. 2018-184725, filed on Sep. 28, 2018. The entire disclosures of these applications are incorporated by reference herein.

BACKGROUND

Field of Invention

The present disclosure relates to a vortex ring generation device.

Background Information

In a vortex ring generation device of Japanese Unexamined Patent Publication No. 2016-86988, vortex ring-shaped air (hereinafter may be simply referred to as a "vortex ring") is discharged from a discharge port when a linear actuator drives a movable member. At this time, a discharge component in a generation source housing chamber is drawn into an air chamber through a component supply port and is contained in the vortex ring to be discharged from the discharge port.

SUMMARY

A first aspect is directed to a vortex ring generation device including a casing having a discharge port, an extrusion mechanism, and a component supply port. The extrusion mechanism extrudes air in an air passage inside the casing such that the air is discharged, in a vortex ring shape, from the discharge port. The component supply port surrounds the air passage, and through which a discharge component is supplied into air. A total circumferential length of the component supply port is ½ or more of a total circumferential length of the discharge port. The extrusion mechanism includes a vibration plate and a drive unit that vibrates the vibration plate. The air passage includes a first passage, and a throttle passage continuous with a downstream end of the first passage. The extrusion mechanism is disposed in the first passage. The throttle passage has a passage area that is smaller downstream. A component chamber is provided inside the casing. The component chamber contains a discharge component to be supplied to the component supply port and being separated from the first passage. The component supply port is located downstream of the throttle passage.

DETAILED DESCRIPTION OF EMBODIMENT(S)

Hereinafter, embodiments of the present disclosure will be described with reference to the drawings. The following embodiments are merely exemplary ones in nature, and are not intended to limit the scope, application, or uses of the invention.

First Embodiment

A vortex ring generation device (10) according to the first embodiment discharges vortex ring-shaped air (a vortex ring (R)). The vortex ring generation device (10) causes a predetermined discharge component to be contained in the vortex ring (R), and then supplies the vortex ring (R) containing the discharge component to, for example, a subject. The discharge component includes substances such as a scent component, water vapor, and a substance having predetermined efficacy. The discharge component is preferably a gas, but may be a liquid. In the case of liquid, the discharge component is preferably a particulate liquid.

Figure 1:
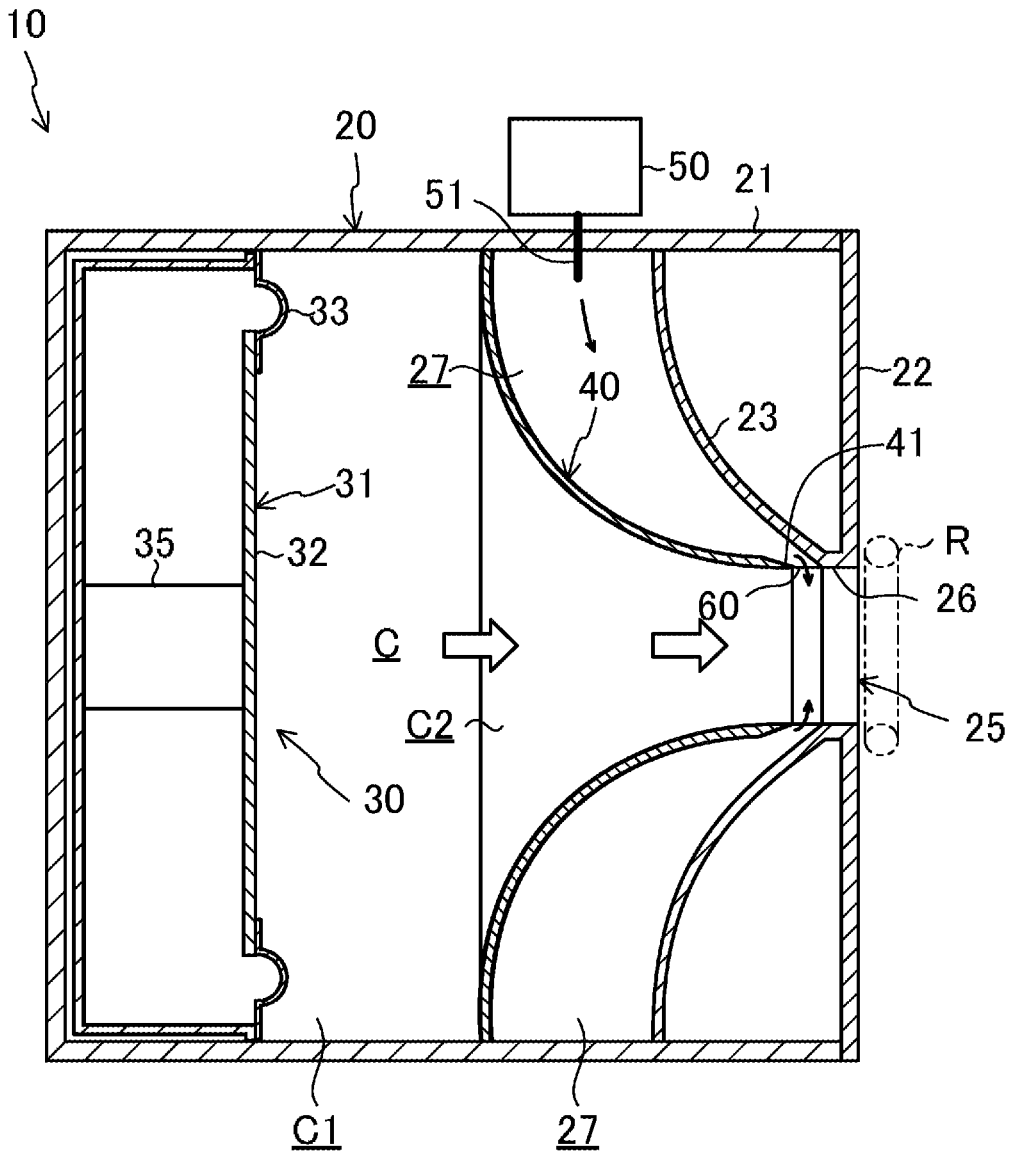
FIG. 1 is a schematic cross-sectional view of an internal structure of a vortex ring generation device according to a first embodiment.

As illustrated in FIG. 1, the vortex ring generation device (10) includes: a casing (20) having a discharge port (25); an extrusion mechanism (30); a passage forming member (40); and a component supply device (50). An air passage (C) through which air flows is located inside the casing (20). In the vortex ring generation device (10), the air in the air passage (C) is extruded by the extrusion mechanism (30), formed into the vortex ring (R), and discharged from the discharge port (25). The vortex ring (R) discharged from the discharge port (25) contains the discharge component supplied from the component supply device (50).

Casing

The casing (20) includes a casing body (21) having a front side open, and a substantially plate-shaped front panel (22) blocking the open face on the front side of the casing body (21). A middle portion of the front panel (22) has the discharge port (25) in the circular shape passing therethrough in a front-rear direction. A peripheral wall (23) in a substantially cylindrical shape continues on a rear surface of the front panel (22). The peripheral wall (23) extends rearward from an inner peripheral edge (26) of the discharge port (25). The peripheral wall (23) has a tapered shape whose diameter becomes smaller frontward. An outer peripheral end of the peripheral wall (23) is fixed to an inner wall of the casing body (21). A distal end of the front side of the peripheral wall (23) is continuous with the inner peripheral edge (26) of the discharge port (25). An center axis of the peripheral wall (23) substantially coincides with that of the discharge port (25).

Passage Forming Member

The passage forming member (40) is disposed rearward of the peripheral wall (23). The passage forming member (40) has a substantially cylindrical shape along an inner peripheral surface of the peripheral wall (23). The passage forming member (40) has a tapered shape whose diameter becomes smaller frontward (i.e., downstream of the air passage (C)). A center axis of the passage forming member (40) substantially coincides with that of the discharge port (25). The center axis of the passage forming member (40) substantially coincides with that of the peripheral wall (23).

A component chamber (27) in which the discharge component is temporarily stored is defined between the inner wall of the casing body (21), the peripheral wall (23), and the passage forming member (40). The component chamber (27) is a substantially cylindrical space surrounding the passage forming member (40).

Extrusion Mechanism

The extrusion mechanism (30) is disposed in the rearward inside the casing (20). The extrusion mechanism (30) has a vibration plate (31) that is a movable member, and a linear actuator (35) that displaces the vibration plate (31) back and forth. The vibration plate (31) includes a vibration plate body (32) and a frame-shaped elastic support (33) disposed at an outer peripheral edge of the vibration plate body (32). The vibration plate (31) is fixed to an inner wall of the casing (20) via the elastic support (33). The linear actuator (35) constitutes a drive unit that vibrates the vibration plate (31) back and forth. A base end (rear end) of the linear actuator (35) is supported by a rear wall of the casing body (21). A leading end (front end) of the linear actuator (35) is coupled with a center portion of the vibration plate (31).

The linear actuator (35) vibrates the vibration plate (31) between a reference position and an extrusion position. Thus, the air (indicated by an open arrow in FIG. 1) in the air passage (C) is extruded frontward.

Air Passage

The air passage (C) extends from the vibration plate (31) to the discharge port (25) in the casing (20). The air passage (C) includes a first passage (C1) and a second passage (C2) continuous with a downstream end of the first passage (C1). The first passage (C1) is surrounded by the inner wall of the casing body (21). A passage area of the first passage (C1) is constant. The second passage (C2) is located inside the passage forming member (40). Specifically, the second passage (C2) is surrounded by the peripheral wall (23). The second passage (C2) constitutes a throttle passage whose passage area is smaller downstream. Thus, in the second passage (C2), the flow velocity of air gradually increases toward its downstream.

Component Supply Device

The component supply device (50) supplies, into the casing (20), the discharge component to be applied to the vortex ring (R). Specifically, the component supply device (50) supplies, via a supply path (51), the predetermined discharge component to the component chamber (27) defined inside the casing (20). The component supply device (50) includes a component generation unit (not shown) that generates the discharge component and a conveyance unit (not shown) that conveys the discharge component generated in the generation unit. The component generation unit is, for example, of a vaporizing type that vaporizes the discharge component from a component raw material. The conveyance unit is, for example, an air pump. The component supply device (50) appropriately supplies, to the component chamber (27), the discharge component whose concentration has been adjusted to a predetermined concentration.

Component Supply Port

The vortex ring generation device (10) has a component supply port (60) for supplying the discharge component to the air passage (C). In the present embodiment, the casing (20) has one component supply port (60). The component supply port (60) is located adjacent to the discharge port (25).

More specifically, the component supply port (60) is located between a downstream end (41) of the passage forming member (40) in a cylinder axial direction and the inner peripheral edge (26) of the discharge port (25). Thus, one annular (strictly speaking, circular) component supply port (60) is located around the downstream end of the air passage (C). Specifically, one annular component supply port (60) is located near the discharge port (25) in the air passage (C).

Figure 2:
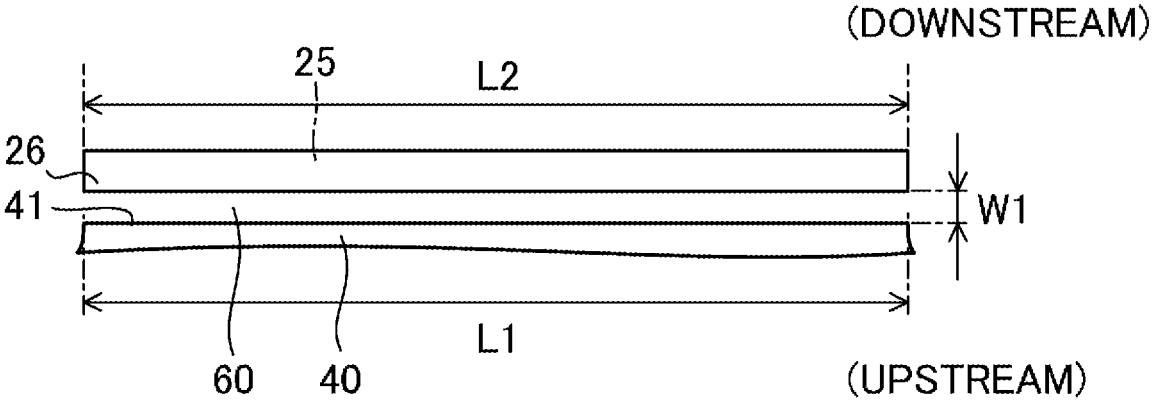
FIG. 2 is a development view of the internal structure adjacent to a discharge port.

FIG. 2 is a development view of an inner peripheral surface of the air passage adjacent to the component supply port (60). As described above, the component supply port (60) of the present embodiment is annular in shape and extends along a circumferential direction of the air passage (C). When L1 represents the circumferential length of one component supply port (60), and W1 represents the width of one component supply port (60), L1 is larger than W1. In addition, the total circumferential length L1 of one component supply port (60) of the present embodiment is equal to the total circumferential length L2 of one discharge port (25). Further, the total circumferential length L1 of one component supply port (60) is equal to or longer than the total circumferential length L2 of one discharge port (25)× ½. In this way, the total circumferential length L1 of one component supply port (60), sufficiently secured with respect to the total circumferential length L2 of one discharge port (25), allows the discharge component in the component chamber (27) to be dispersed in the circumferential direction of the air passage (C) when supplied to the air. Note that the circumferential length L1 of one component supply port (60) is preferably equal to or shorter than the circumferential length L2 of one discharge port (25).

Operation

The basic operation of the vortex ring generation device (10) will be described with reference to FIG. 1.

When the vortex ring generation device is in operation, the linear actuator (35) vibrates the vibration plate (31). When the vibration plate (31) deforms frontward, the volume of the air passage (C) decreases. As a result, the air in the air passage (C) flows toward the discharge port (25).

The air in the first passage (C1) flows into the second passage (C2). In the second passage (C2), the passage area gradually decreases, so that the flow velocity of air increases. When the flow velocity of the air increases, the pressure of the air decreases. In particular, an outlet end of the second passage (C2) has the smallest passage area. Therefore, the flow velocity of the air at the outlet end of the second passage (C2) is substantially the highest in the air passage (C). Consequently, the pressure of the air at the outlet end of the second passage (C2) is substantially the lowest.

The component supply port (60) is located at the outlet end of the second passage (C2). Therefore, when the air at low pressure passes through the component supply port (60), the discharge component in the component chamber (27) is sucked into the air passage (C) due to the difference between the pressure of the air and the pressure in the component chamber (27). Specifically, the discharge component in the component chamber (27) is sucked into the air passage (C) by the dynamic pressure passing through the component supply port (60).

The constant flow velocity of the air passing through the component supply port (60) allows a constant amount of the discharge component to be sucked from the component supply port (60). This allows the concentrations of the discharge component in the air and the vortex ring (R) to be controlled to be constant.

Since the component supply port (60) has an annular shape surrounding the air passage (C), the discharge component in the component chamber (27) is dispersed over the entire circumference of the air passage (C). Further, the discharge component is easily applied to air near the outer periphery in the air flowing through the air passage (C). This allows the discharge component to be uniformly applied to the air near the outer periphery in the air passage (C).

In this way, the air containing the discharge component reaches the discharge port (25) immediately. The air passing through the discharge port (25) has a relatively high flow velocity, whereas the air around the discharge port (25) is still. For this reason, a shearing force acts on the air at discontinuous planes of both air flows, and a vortex flow is generated adjacent to an outer peripheral edge of the discharge port (25). The vortex flow forms a vortex ring-shaped air (vortex ring (R) schematically shown in FIG. 1) moving frontward from the discharge port (25). The vortex ring (R) containing the discharge component is supplied to the subject.

As described above, the discharge component is supplied over the entire circumference of the air flow from the component supply port (60). Therefore, the discharge component is also dispersed in the vortex ring (R) circumferentially. This allows reduction in uneven distribution of the discharge component in the vortex ring (R). The discharge component is supplied from the component supply port (60), in particular, to the air near the outer periphery. This allows most of the discharge component in the component chamber (27) to be contained in the vortex ring (R).

The component supply port (60) is located adjacent to the discharge port (25). If the component supply port (60) and the discharge port (25) are relatively far away from each other, the discharge component supplied into the air may diffuse before reaching the discharge port (25), and the amount of the discharge component contained in the vortex ring (R) may decrease. To address this problem, the component supply port (60) and the discharge port (25) are made close to each other, thereby allowing reduction in such diffusion of the discharge component.

The component supply port (60) located adjacent to the discharge port (25) is located substantially at the most downstream end of the air passage (C). This allows a sufficient distance between the component supply port (60) and the extrusion mechanism (30) (strictly speaking, the vibration plate (31)) to be secured. This sufficient distance allows reduction in adhesion of the discharge component which has been supplied from the component supply port (60), to the extrusion mechanism (30) even if the air in the air passage (C) flows slightly backward due to the vibration of the vibration plate (31). This reduction allows avoidance of an increase in frequency of maintenance of the extrusion mechanism (30) and peripheral components thereof required due to adhesion of the discharge component, for example.

The annular component supply port (60) causes equalization of the flow velocity of the air passing through the discharge port (25) in the circumferential direction, as compared to a case in which the component supply port (60) is provided unevenly in the circumferential direction, for example. This allows the vortex ring (R) to be stably formed at the discharge port (25).

Movement of Vibration Plate of Extrusion Mechanism

Figure 3:
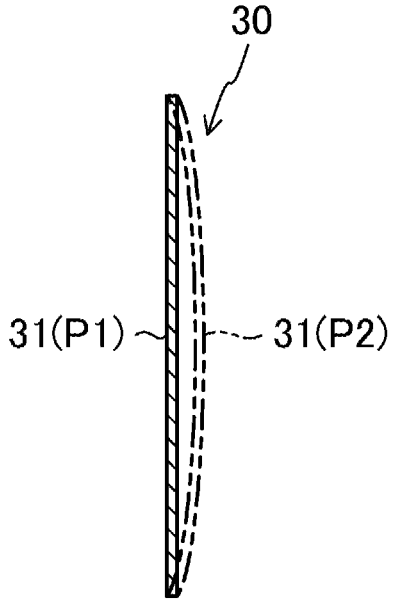
FIG. 3 is a diagram schematically illustrating a change in a position of a vibration plate during operation.
Figure 4:
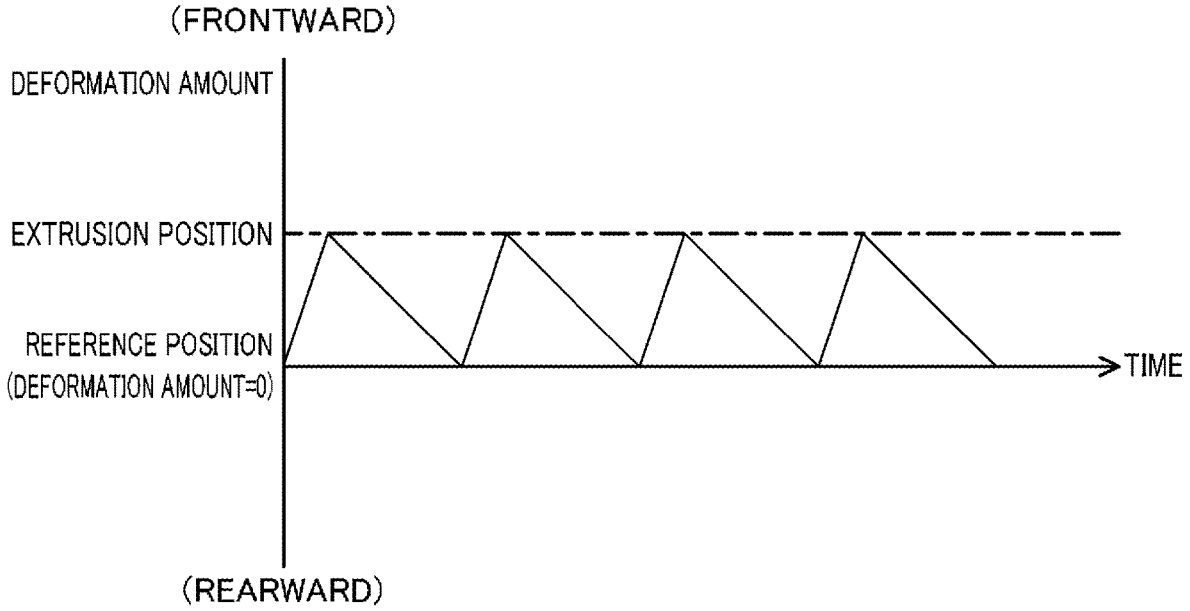
FIG. 4 is a graph showing a change in a deformation amount of the vibration plate according to the first embodiment.

As illustrated in FIGS. 3 and 4, during operation of the vortex ring generation device (10), the vibration plate (31) vibrates between the reference position and the extrusion position. When the extrusion mechanism (30) is stopped, the vibration plate (31) returns to the reference position (the position indicated by P1 in FIG. 3). At the reference position, the deformation amount of the vibration plate (31) is zero, i.e., the vibration plate (31) is in flat (stands vertically in the present example). On the other hand, when the vibration plate (31) is at the extrusion position (the position indicated by P2 in FIG. 3), the vibration plate (31) deforms frontward (downstream of the air passage (C)). Specifically, the vibration plate (31) protrudes frontward. In this way, the vibration plate (31) vibrates between the reference position and the extrusion position and does not deform further rearward than the reference position.

Figure 5:
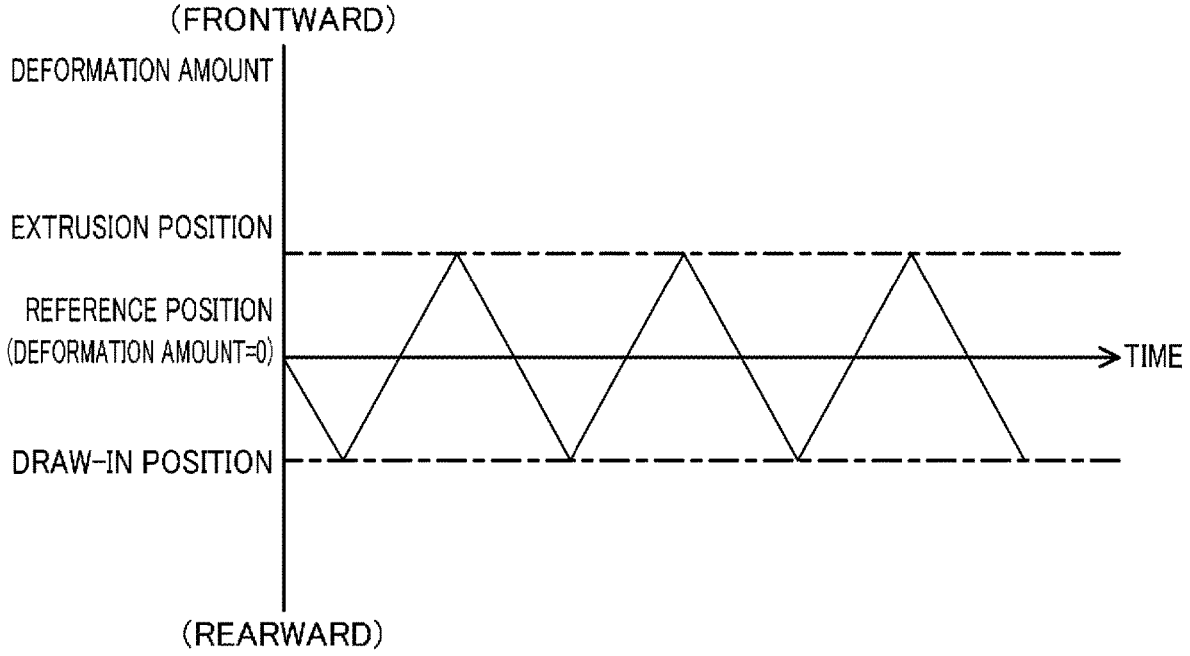
FIG. 5 is a graph showing a change in a deformation amount of the vibration plate according to a comparative example.

On the other hand, as in a comparative example shown in FIG. 5, for example, when the vibration plate (31) vibrates between a position further rearward than the reference position (referred to as a draw-in position) and the extrusion position, the deformation amount of the vibration plate (31) moving rearward increases, which promotes the backflow of air in the air passage (C). By contrast, in the present embodiment, the vibration plate (31) does not deform further rearward than the reference position. This allows the reduction in the backflow of air. Therefore, as described above, it is possible to reduce, for example, adhesion of the discharge component to the vibration plate (31) and the like.

In addition, in the extrusion mechanism (30) of the present embodiment, the velocity V2 of the vibration plate (31) moving from the extrusion position to the reference position is smaller than the velocity V1 of the same moving from the reference position to the extrusion position. Specifically, in the extrusion mechanism (30), the vibration plate (31) at the extrusion position slowly returns to the reference position. This allows reliable reduce in the backflow of air in the air passage (C). Note that the velocities V1 and V2 mentioned herein include an average velocity and a maximum velocity.

Advantages of First Embodiment

According to the first embodiment, the total circumferential length L1 of the component supply port (60) is equal to or longer than ½ of the total circumferential length L2 of the discharge port (25). The perimeter of the vortex ring (R) is dominated by the circumferential length of the discharge port (25). Therefore, satisfying the relationship $L1 > L2 \times (1/2)$ allows the circumferential length of the component supply port (60) with respect to the perimeter of the vortex ring (R) to be sufficiently ensured, and allows the reduction in uneven distribution of the discharge component contained in the vortex ring (R). Further, opening the component supply port (60) to the air passage (C) allows the discharge component in the component chamber (27) to be sucked into the air passage (C) by using the dynamic pressure of the air flowing through the air passage (C).

In the first embodiment, the component supply port (60) has an annular shape. This allows the discharge component to be supplied over the entire circumference of the air in the air passage (C), and the discharge component in the vortex ring (R) to be equalized over the entire circumference. Further, the discharge component can be supplied to the air near the outer periphery of the air flowing through the air passage (C). This allows the reduction in consumption of the discharge component without being supplied to the vortex ring (R). Further, when the component supply port (60) is located only in a circumferential part of the air passage (C), for example, the flow velocity of the air flowing through the discharge port (25) may become uneven circumferentially due to the unevenly provided component supply port (60). By contrast, the present configuration allows the flow velocity of the air flowing through the discharge port (25) to be equalized circumferentially, thereby forming the vortex ring (R) having a stable shape.

In the first embodiment, the second passage (C2) (throttle passage (C2)) whose passage area decreases downstream is provided. The component supply port (60) is disposed at the downstream end of the throttle passage (C2). This allows the flow velocity of the air passing through the component supply port (60) to be increased, and the discharge component in the component chamber (27) to be reliably sucked into the air. Further, the increase in the flow velocity of the air passing through the component supply port (60) allows the backflow of the air containing the discharge component to be reliably reduced.

In the first embodiment, the component supply port (60) is located adjacent to the discharge port (25). This allows reduction in diffusion of the discharge component before the air flows out to the discharge port (25). As a result, the discharge component is reliably applied to the vortex ring (R). Further, it is possible to reduce adhesion of the discharge component which has been supplied from the component supply port (60), to the extrusion mechanism (30) and peripheral parts thereof.

In the first embodiment, the component supply port (60) is located between the downstream end (41) of the cylindrical passage forming member (40) and the inner peripheral edge (26) of the discharge port (25). This allows the annular component supply port (60) to be easily located at a position closest to the discharge port (25) without processing for forming the component supply port (60).

In the first embodiment, the component chamber (27) is defined between the casing (20) and the passage forming member (40). This allows the component chamber (27) to be located near the component supply port (60) while the passage forming member (40) is used.

In the first embodiment, the extrusion mechanism (30) vibrates the vibration plate (31) between the reference position at which the deformation amount of the vibration plate (31) is zero and the extrusion position at which the vibration plate (31) is deformed further downstream of the air passage (C) than the reference position. This allows the amount of backflow of air in the air passage (C) to be reduced as compared to the comparative example shown in FIG. 5. Therefore, it is possible to reduce adhesion of the discharge component to the extrusion mechanism (30) and peripheral parts thereof due to such a backflow.

First Variation of First Embodiment

In the first variation of the first embodiment, a plurality of component supply ports (60) are located inside the casing (20) within the same configuration as that of the first embodiment. The plurality of (four in the present example) component supply ports (60) are located adjacent to the discharge port (25), as in the first embodiment. Specifically, the plurality of component supply ports (60) are formed by a plurality of notched holes located in the downstream end (41) of the passage forming member (40), for example. The plurality of component supply ports (60) are arranged at equal intervals circumferentially. Thus, the discharge component can be uniformly supplied into the air.

Blocking surfaces (B) are located between adjacent component supply ports (60) of the plurality of component supply ports (60). Specifically, each blocking surface (B) is located between the component supply ports (60) circumferentially adjacent to each other, in the inner peripheral surface of the air passage (C). The number of component supply ports (60), and the number of blocking surfaces (B) are merely examples, and may be any numbers of at least two.

Figure 6:
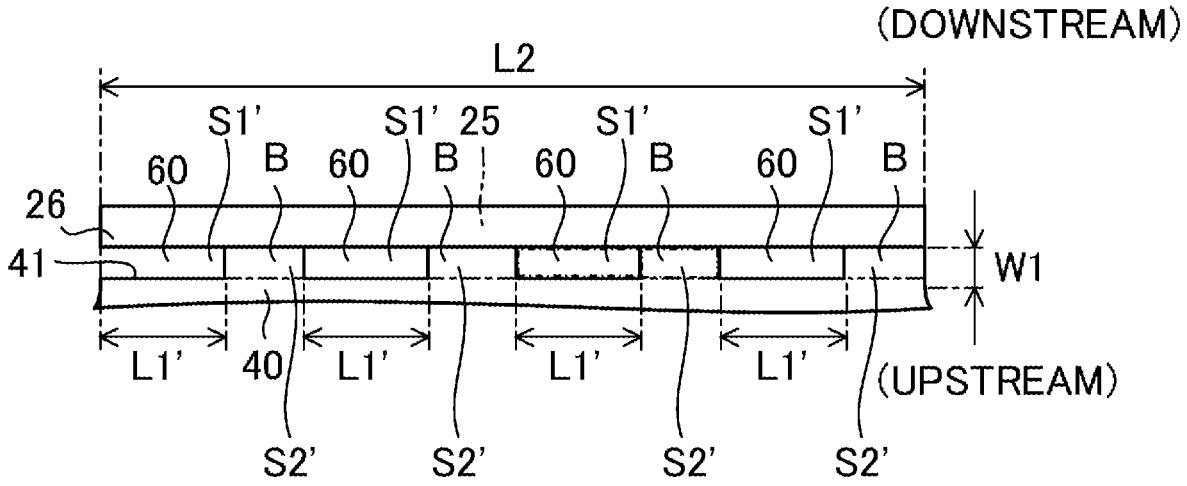
FIG. 6 is a development view of an internal structure adjacent to a discharge port according to a variation of the first embodiment.

As shown in the development view of FIG. 6, each of the component supply ports (60) extends in the circumferential direction of the air passage (C) so that the circumferential length L1' of the component supply port (60) is larger than the width W1 of the component supply port (60). This allows, as in the first embodiment, the discharge component to be dispersed in the circumferential direction of the air passage (C) when supplied.

In the present example, the sum of the circumferential lengths L1' of the component supply ports (60) (i.e., the total length L1) is ½ or more of the total circumferential length L2 of one discharge port (25). This allows, as in the first embodiment, the circumferential length L1 of the component supply port (60), as a whole, to be sufficiently ensured with respect to the perimeter of the vortex ring (R), and allows reduction in uneven distribution of the discharge component in the vortex ring (R).

S1 represents the sum (total opening area) of opening areas of the openings (regions S1' in FIG. 6) of the component supply ports (60), and S2 represents the sum (total area) of the areas of the openings (regions S2' in FIG. 6) of the blocking surfaces (B). In this case, the component supply ports (60) of the present example satisfy the relationship of S1>S2. This allows the sufficient circumferential opening areas of the component supply ports (60) to be ensured, and allows reduction in uneven distribution of the discharge component in the vortex ring (R).

Second Embodiment

Figure 7:
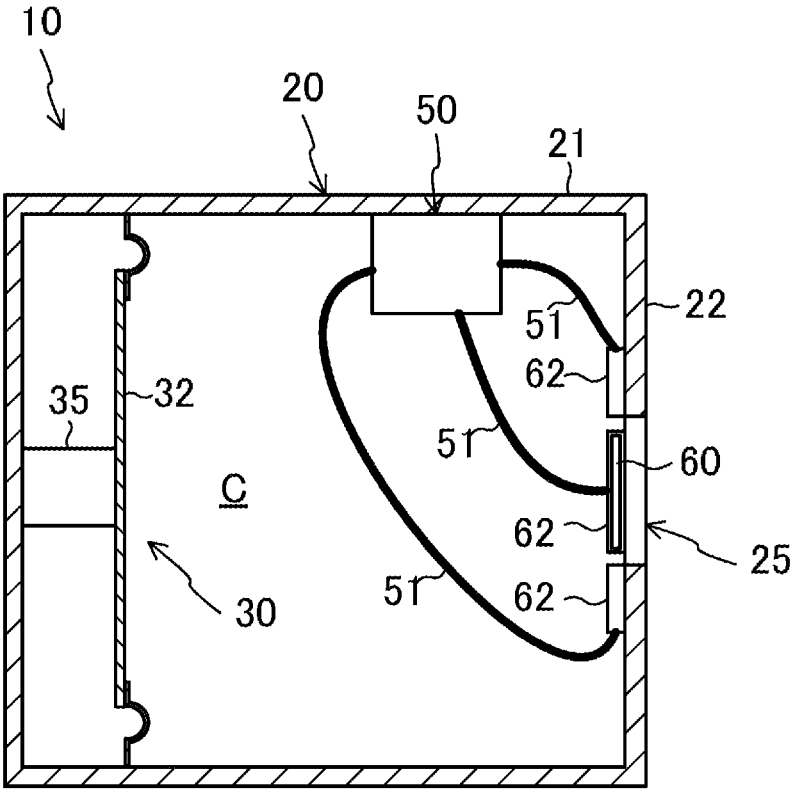
FIG. 7 is a diagram schematically illustrating a vortex ring generation device according to a second embodiment.
Figure 8:
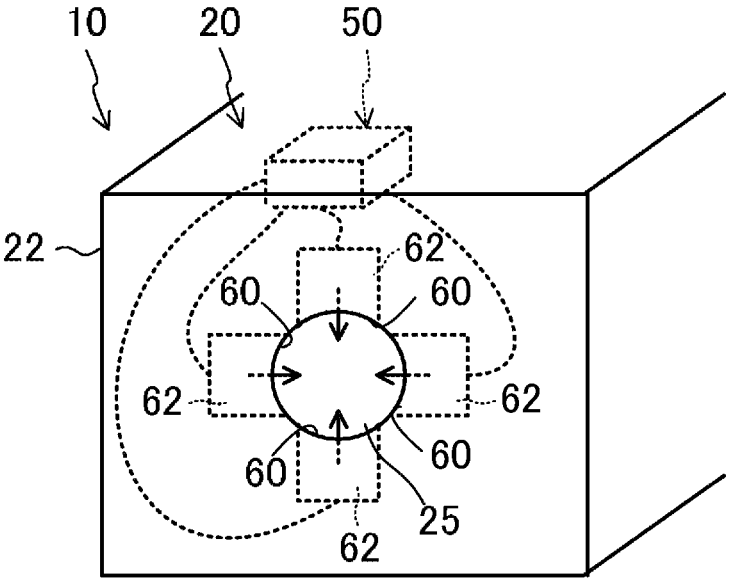
FIG. 8 is a diagram schematically illustrating the vortex ring generation device according to the second embodiment.

The vortex ring generation device (10) of the second embodiment shown in FIGS. 7 and 8 has a structure of the component supply port (60) different from that of the above-described embodiment and variation. In the second embodiment, a plurality of (four in the present example) nozzles (62) are arranged in the air passage (C) so as to surround an inflow end of the discharge port (25). The nozzles (62) are arranged at equal intervals circumferentially around the center axis of the discharge port (25). Each of the nozzles (62) is connected to the component supply device (50) via a tubular supply path (51).

A component supply port (60) is located at the distal end of each of the nozzles (62). The component supply port (60) is located adjacent to the inflow end of the discharge port (25) so as to face the center axis of the discharge port (25). The component supply port (60) of each of the nozzles (62) extends in the circumferential direction of the discharge port (25). Specifically, the circumferential length L1' of each of the component supply ports (60) is larger than the width W1 thereof. In the present embodiment, the total length L1 that is the sum of circumferential lengths L1' of the component supply ports (60) is ½ or more of the total circumferential length L2 of the discharge port (25).

When the vortex ring generation device (10) is operated, the discharge component from the component supply device (50) is supplied to each nozzle (62) via the supply path (51). The discharge component is supplied from the component supply port (60) of each of the nozzles (62) toward the air flowing into the discharge port (25). The air containing the discharge component is discharged from the discharge port (25) as the vortex ring (R).

Further, in the present example, each of the component supply ports (60) extends circumferentially. This allows the discharge component to be dispersed circumferentially when supplied to the air flowing into the discharge port (25). This allows reduction in uneven distribution of the discharge component in the circumferential direction of the vortex ring (R). Further, the total circumferential length L1 of each of the component supply ports (60) is ½ or more of the total circumferential length L2 of the discharge port (25). This allows the total circumferential length L1 of the component supply port (60) to be sufficiently secured with respect to the perimeter of the vortex ring (R).

Third Embodiment

Figure 9:
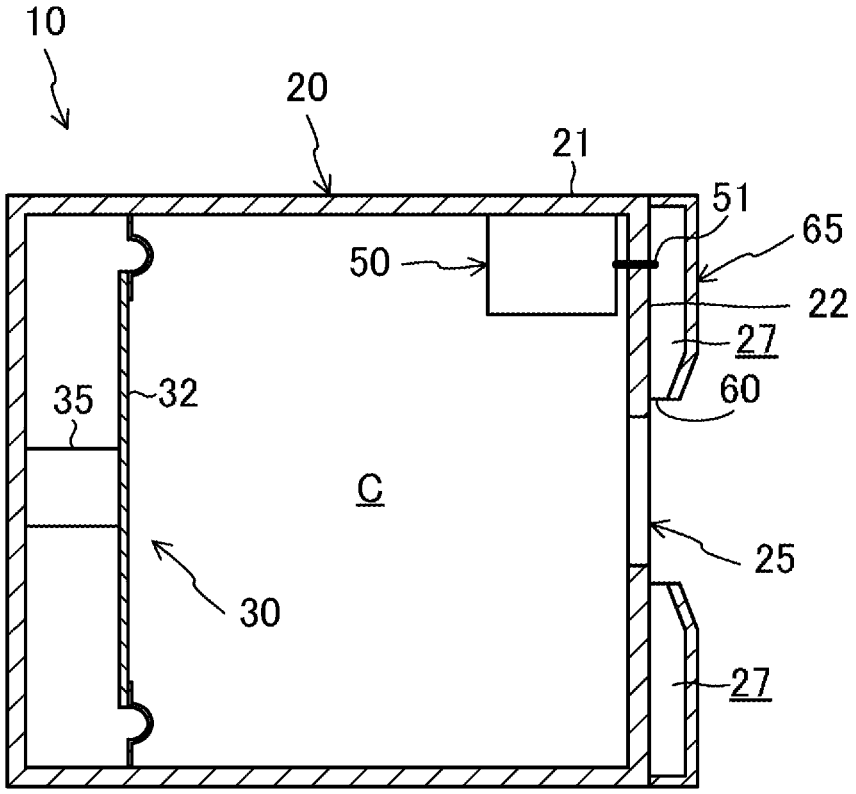
FIG. 9 is a diagram schematically illustrating a vortex ring generation device according to a third embodiment.
Figure 10:
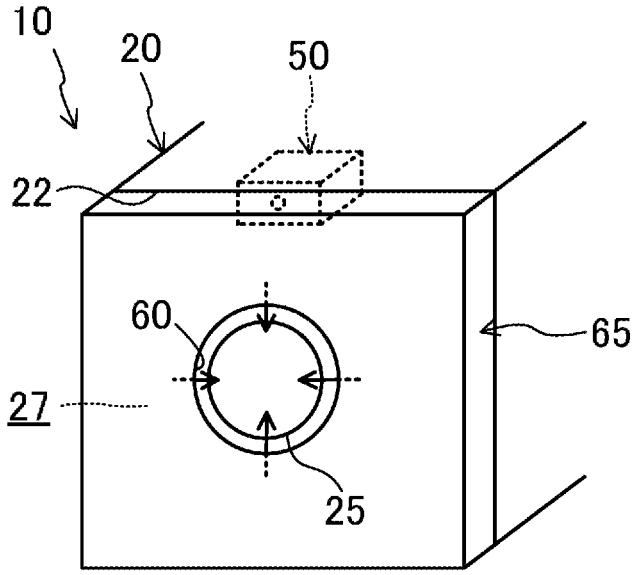
FIG. 10 is a diagram schematically illustrating the vortex ring generation device according to the third embodiment.

The vortex ring generation device (10) of the third embodiment shown in FIGS. 9 and 10 has a structure of the component supply port (60) different from that of the above-described embodiments and variation. In the third embodiment, a duct (65) for supplying the discharge component to the outside of the casing (20) is provided. The duct (65) is arranged along the front panel (22) of the casing (20). The duct (65) has a hollow frame shape with a cylindrical space formed therein. This space constitutes a component chamber (27). The component chamber (27) is appropriately supplied with the discharge component from the component supply device (50).

An annular component supply port (60) surrounding the discharge port (25) is located at the center of the front surface of the duct (65). The component supply port (60) is in communication with the component chamber (27) inside the duct (65). The discharge component is discharged from the component supply port (60) to the vortex ring (R) discharged from the discharge port (25). The component supply port (60) extends in the circumferential direction of the discharge port (25) such that its total circumferential length L1 is larger than its width W1 in the air-flow direction. The total circumferential length L1 of the component supply port (60) is ½ or more of the total circumferential length L2 of the discharge port (25) and is equal to L2. This allows the discharge component to be dispersed circumferentially when supplied to the vortex ring (R) discharged from the discharge port (25).

Fourth Embodiment

Figure 11:
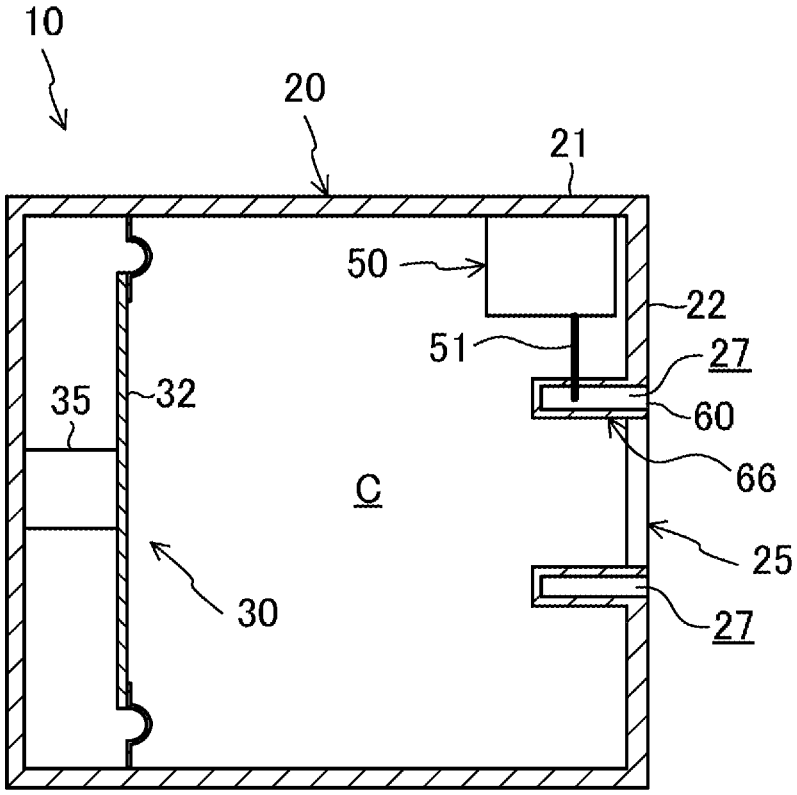
FIG. 11 is a diagram schematically illustrating a vortex ring generation device according to a fourth embodiment.
Figure 12:
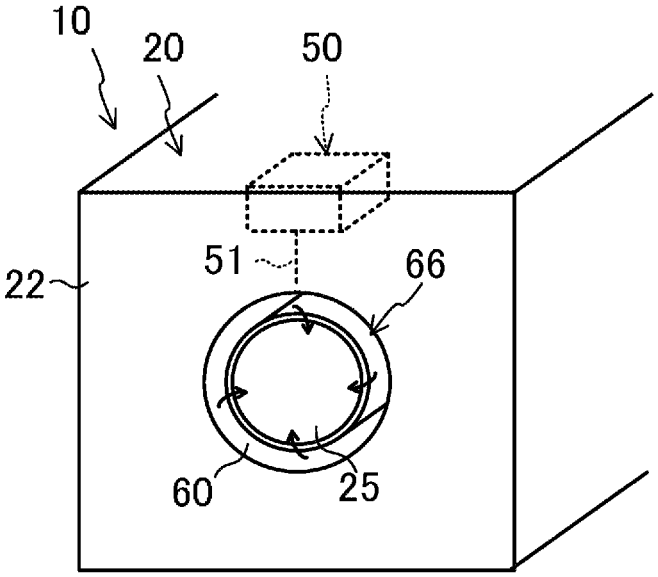
FIG. 12 is a diagram schematically illustrating the vortex ring generation device according to the fourth embodiment.

The vortex ring generation device (10) of the fourth embodiment shown in FIGS. 11 and 12 has a structure of the component supply port (60) different from that of the above-described embodiments and variation. In the fourth embodiment, a cylindrical nozzle (66) surrounding the discharge port (25) is located in the front side of the casing (20). The cylindrical nozzle (66) is formed so as to be recessed rearward from the front panel (22) of the casing (20) and has a cylindrical component chamber (27) located therein. An annular opening is located in the front side (distal end) of the cylindrical nozzle (66). The opening constitutes the component supply port (60). The axial length L1 of the component supply port (60) is larger than the radial width W1 thereof.

In this embodiment, the total circumferential length L1 of the component supply port (60) is ½ or more of the total circumferential length L2 of the discharge port (25) and is larger than L2. This allows the discharge component to be dispersed circumferentially when supplied to the vortex ring (R) discharged from the discharge port (25).

In the present embodiment, the component supply port (60) is annular in shape. This allows the discharge component to be supplied over the entire periphery of the vortex ring (R). Further, the present embodiment allows the discharge component in the component chamber (27) to be sucked from the component supply port (60) by using the dynamic pressure of the vortex flow of the vortex ring (R).

While the embodiments and the variation thereof have been described above, it will be understood that various changes in form and details may be made without departing from the spirit and scope of the claims. The embodiments, the variation thereof, and the other embodiments may be combined and replaced with each other without deteriorating intended functions of the present disclosure. The expressions of "first," "second," "third," described above are used to distinguish the words to which these expressions are given, and the number and order of the words are not limited.

The present disclosure is useful for a vortex ring generation device.

The invention claimed is:

1. A vortex ring generation device comprising:

a casing having a discharge port;

an extrusion mechanism configured to extrude air in an air passage inside the casing such that the air is discharged, in a vortex ring shape, from the discharge port; and a component supply port surrounding the air passage, and through which a discharge component is supplied into air, a total circumferential length of the component supply port is ½ or more of a total circumferential length of the discharge port, the extrusion mechanism including a vibration plate and a drive unit configured to vibrate the vibration plate, the drive unit being a linear actuator disposed in the casing, and the air passage including a first passage having the extrusion mechanism disposed therein, and a throttle passage continuous with a downstream end of the first passage and having passage area that is smaller downstream, an opening area of an inflow end of the throttle passage being larger than an area of a front surface of the vibration plate, a component chamber is provided inside the casing, the component chamber containing a discharge component to be supplied to the component supply port and being separated from the first passage, and the component supply port being located downstream of the throttle passage.

2. The vortex ring generation device of claim 1, wherein the component supply port has an annular shape.

3. The vortex ring generation device of claim 1, wherein the component supply port is located adjacent to the discharge port.

4. The vortex ring generation device of claim 1, wherein the component supply port includes a plurality of component supply ports, and the plurality of component supply ports are arranged at equal intervals circumferentially.

5. The vortex ring generation device of claim 1, wherein the component supply port is located in an inner peripheral surface of the air passage, and a total opening area of the component supply port is larger than a total area of a blocking surface that is circumferentially adjacent to the component supply port in the inner peripheral surface of the air passage.

6. The vortex ring generation device of claim 1, wherein a cylindrical passage forming member is provided inside the casing, the cylindrical passage forming member forming at least a part of the air passage, and the component supply port is located between a downstream end of the cylindrical passage forming member and an inner peripheral edge of the discharge port.

7. The vortex ring generation device of claim 6, wherein the component chamber is defined between the casing and the cylindrical passage forming member, the component chamber storing the discharge component to be supplied to the component supply port.

8. The vortex ring generation device of claim 1, wherein the extrusion mechanism is configured to vibrate the vibration plate between a reference position at which a deformation amount of the vibration plate is zero and an extrusion position at which the vibration plate is deformed further downstream of the air passage than the reference position.

9. The vortex ring generation device of claim 2, wherein the component supply port is located adjacent to the discharge port.

10. The vortex ring generation device of claim 2, wherein the component supply port includes a plurality of component supply ports, and the plurality of component supply ports are arranged at equal intervals circumferentially.

11. The vortex ring generation device of claim 3, wherein the component supply port includes a plurality of component supply ports, and the plurality of component supply ports are arranged at equal intervals circumferentially.

12. The vortex ring generation device of claim 2, wherein the component supply port is located in an inner peripheral surface of the air passage, and a total opening area of the component supply port is larger than a total area of a blocking surface that is circumferentially adjacent to the component supply port in the inner peripheral surface of the air passage.

13. The vortex ring generation device of claim 3, wherein the component supply port is located in an inner peripheral surface of the air passage, and a total opening area of the component supply port is larger than a total area of a blocking surface that is circumferentially adjacent to the component supply port in the inner peripheral surface of the air passage.

14. The vortex ring generation device of claim 4, wherein the component supply port is located in an inner peripheral surface of the air passage, and a total opening area of the component supply port is larger than a total area of a blocking surface that is circumferentially adjacent to the component supply port in the inner peripheral surface of the air passage.

15. The vortex ring generation device of claim 2, wherein a cylindrical passage forming member is provided inside the casing, the cylindrical passage forming member forming at least a part of the air passage, and the component supply port is located between a downstream end of the cylindrical passage forming member and an inner peripheral edge of the discharge port.

16. The vortex ring generation device of claim 3, wherein a cylindrical passage forming member is provided inside the casing, the cylindrical passage forming member forming at least a part of the air passage, and the component supply port is located between a downstream end of the cylindrical passage forming member and an inner peripheral edge of the discharge port.

17. The vortex ring generation device of claim 4, wherein a cylindrical passage forming member is provided inside the casing, the cylindrical passage forming member forming at least a part of the air passage, and the component supply port is located between a downstream end of the cylindrical passage forming member and an inner peripheral edge of the discharge port.

18. The vortex ring generation device of claim 5, wherein a cylindrical passage forming member is provided inside the casing, the cylindrical passage forming member forming at least a part of the air passage, and the component supply port is located between a downstream end of the cylindrical passage forming member and an inner peripheral edge of the discharge port.

19. The vortex ring generation device of claim 15, wherein the component chamber is defined between the casing and the cylindrical passage forming member, the component chamber storing the discharge component to be supplied to the component supply port.

20. The vortex ring generation device of claim 16, wherein the component chamber is defined between the casing and the cylindrical passage forming member, the component chamber storing the discharge component to be supplied to the component supply port.

* * * * *